US008640923B2

(12) United States Patent
Scatizzi

(10) Patent No.: US 8,640,923 B2
(45) Date of Patent: Feb. 4, 2014

(54) DEVICE FOR DOSING DYES FOR THE PREPARATION OF DYEING BATHS

(75) Inventor: Mario Scatizzi, Prato (IT)

(73) Assignee: Tecnorama S.R.L., Prato (IT)

( * ) Notice: Subject to any disclaimer, the term of this patent is extended or adjusted under 35 U.S.C. 154(b) by 85 days.

(21) Appl. No.: 13/387,200

(22) PCT Filed: Jul. 22, 2010

(86) PCT No.: PCT/IT2010/000331

§ 371 (c)(1),
(2), (4) Date: Jan. 26, 2012

(87) PCT Pub. No.: WO2011/013158

PCT Pub. Date: Feb. 3, 2011

(65) Prior Publication Data

US 2012/0118914 A1 May 17, 2012

(30) Foreign Application Priority Data

Jul. 30, 2009 (IT) ..... FI09A0169

(51) Int. Cl.
*B67D 7/70* (2010.01)

(52) U.S. Cl.
USPC ..... 222/137; 222/1; 222/63; 222/72; 222/135; 222/144.5; 222/318; 222/340; 222/386

(58) Field of Classification Search
USPC ..... 222/132, 134, 135, 137, 144.5, 318; 141/104, 236; 73/1.74, 1.21, 1.19, 73/1.16; 422/100
See application file for complete search history.

(56) References Cited

U.S. PATENT DOCUMENTS

| | | | | |
|---|---|---|---|---|
| 3,498,342 | A * | 3/1970 | Sanderson | 141/238 |
| 4,632,147 | A | 12/1986 | Whaley | |
| 6,457,496 | B1 | 10/2002 | Chuang | |
| 6,494,687 | B2 * | 12/2002 | Lang et al. | 417/296 |
| 7,111,652 | B2 * | 9/2006 | Koide et al. | 141/104 |
| 7,111,757 | B1 * | 9/2006 | O'Brien et al. | 222/71 |

(Continued)

FOREIGN PATENT DOCUMENTS

| | | | |
|---|---|---|---|
| EP | 0 421 742 | A1 | 4/1991 |
| EP | 0 654 298 | A1 | 5/1995 |
| EP | 0 945 728 | A2 | 9/1999 |
| WO | 99/24155 | A2 | 5/1999 |

*Primary Examiner* — Paul R Durand
*Assistant Examiner* — Jeremy W Carroll
(74) *Attorney, Agent, or Firm* — McGlew and Tuttle, P.C.

(57) ABSTRACT

Device for dosing dyes in solution or dispersion for the preparation of dye baths for textile materials, comprising a plurality of pipettes (1) individually connected to corresponding bottles or containers (6) containing the said dyes, the said bottles or containers being respectively connected to a dosing head (8) through corresponding ducts (9) from which the dyes exit. The device comprises programmable means (EU) which individually control the said pipettes (1) and respective electrovalves (4) and which, depending on the formulation programmed to realize a dye bath, operate the automatic subdivision or selection of the electrovalves (4) in two groups. A first group of electrovalves (4) initially connect the respective bottles (6) with the corresponding pipettes (1) through the ducts (5) and (7), as the electrovalves (4) of the second group, and in a subsequent step connect the respective pipettes (1) with the dosing head (8) through the ducts (5) and (9) and then restore the individual links once the dosing is completed; the electrovalves (4) of the second group constantly maintain the connection between the respective pipettes (1) and the corresponding bottles (6).

10 Claims, 6 Drawing Sheets

(56) References Cited

U.S. PATENT DOCUMENTS

| | | | | |
|---|---|---|---|---|
| 7,632,529 | B2 * | 12/2009 | Lang | 426/249 |
| 8,220,503 | B2 * | 7/2012 | Tribble et al. | 141/27 |
| 2004/0020942 | A1 * | 2/2004 | Ingenhoven et al. | 222/135 |
| 2004/0177682 | A1 * | 9/2004 | Anguillesi et al. | 73/159 |
| 2005/0214172 | A1 * | 9/2005 | Burgisser | 422/100 |
| 2006/0272516 | A1 * | 12/2006 | Carbonini | 99/452 |
| 2010/0032052 | A1 * | 2/2010 | Bartholomew | 141/9 |

* cited by examiner

DEVICE FOR DOSING DYES FOR THE PREPARATION OF DYEING BATHS

The present invention relates to a device, in particular a multi-pipette device, for dosing colouring agents in the form of a solution or dispersion destined to the preparation of dyeing baths for textile materials.

Known devices comprising more pipette-distributors are used to contemporarily distribute and to dose more liquid products in order to minimize the time necessary for the preparation of solutions based on formulations or "recipes" which require more components.

The said devices function according to the diagram shown in FIG. 1: a three-path valve (V) is mounted on the exit of each pipette (P) which is electronically operated and connected to a bottle (B) containing a liquid component by means of a first conduit (C1), and to the same pipette (P) and, on the exit, with a second conduit (C2) ending in a dosing head (not shown) into which analogous conduits from other valves, singularly mounted on their corresponding pipettes, converge.

One of the main drawbacks connected with the use of said device arises from the fact that the conduits (C2) connecting each of said thee-path valves (V) to the dosing head are extremely long and full of liquid drawn from the corresponding bottles (B), so the liquid is replaced in said conduits only when the dosage of the products that they contain is executed. In other words, the product contained in each of the conduits ending in the dosing head stagnates therein, until a further distribution of the product in the programmed cycle takes place. A prolonged permanence of the product in the conduit (C2) causes the sedimentation of the solute in the lower part and on the walls of the conduit with evident precision problems in the subsequent measurements.

Moreover, due to the length of the conduits (C2) an undesired dripping of the product during the dosing of the other components may take place and, consequently, an incorrect execution of the programmed formula may be performed.

A further drawback arises from the fact that the length of the conduit (C2) varies from pipette to pipette.

The main aim of the present invention is to eliminate, or at least to remarkably reduce, said drawbacks.

These results have been achieved, according to the present invention, by adopting the idea of making a device having the features described in claim 1.

Further features of the present invention are the subject of the dependent claims.

Thanks to the present invention, the conduits connecting the three-path valves to the dosing head can conveniently be shortened and do not exhibit sedimentation or dripping problems. Moreover, a device according to the present invention is relatively easy to build, reliable and economical in comparison with the advantages that it offers.

Every technician who works in this field will better understand these advantages and further advantages and features of the present invention thanks to the following description and to the enclosed drawings which are provided for illustration purposes but should not be considered in a limitative sense, wherein.

Figure 2:
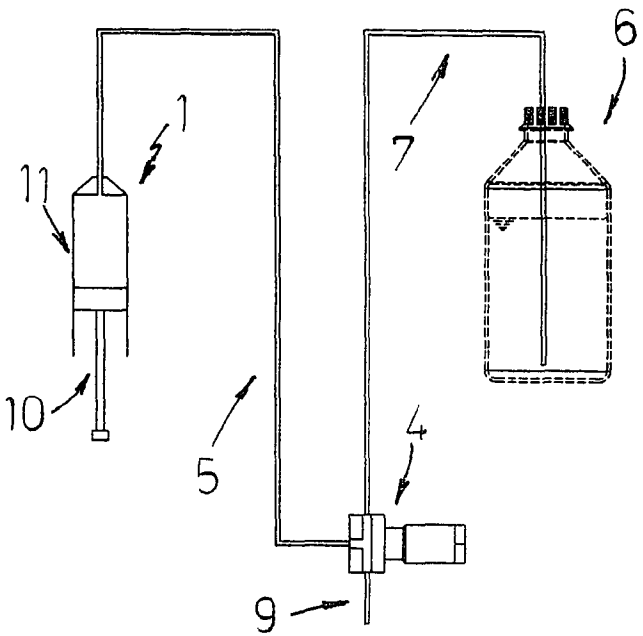
FIG. 2 shows a functional diagram which is graphically analogous to the device shown in FIG. 1 but refers to a part of a device according to the present invention.
Figure 1:
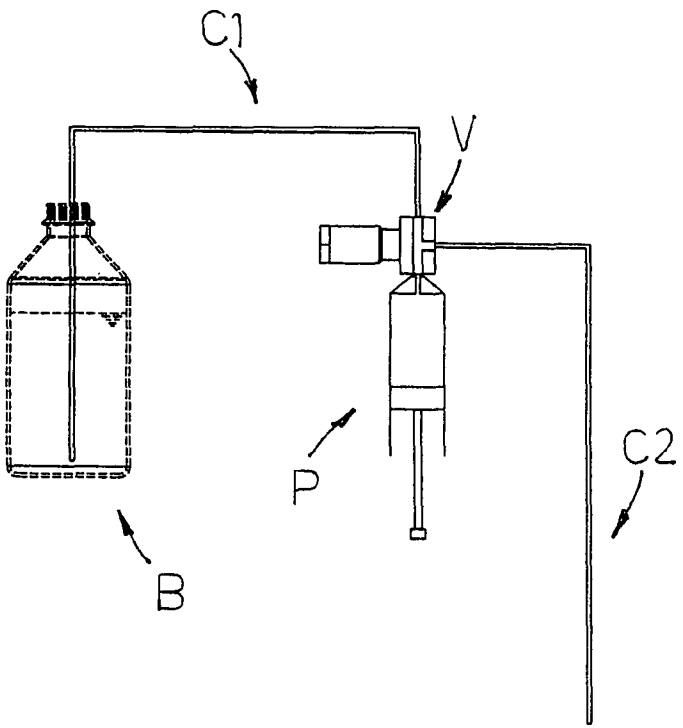
FIG. 1 shows a diagram concerning a known device.
Figure 3:
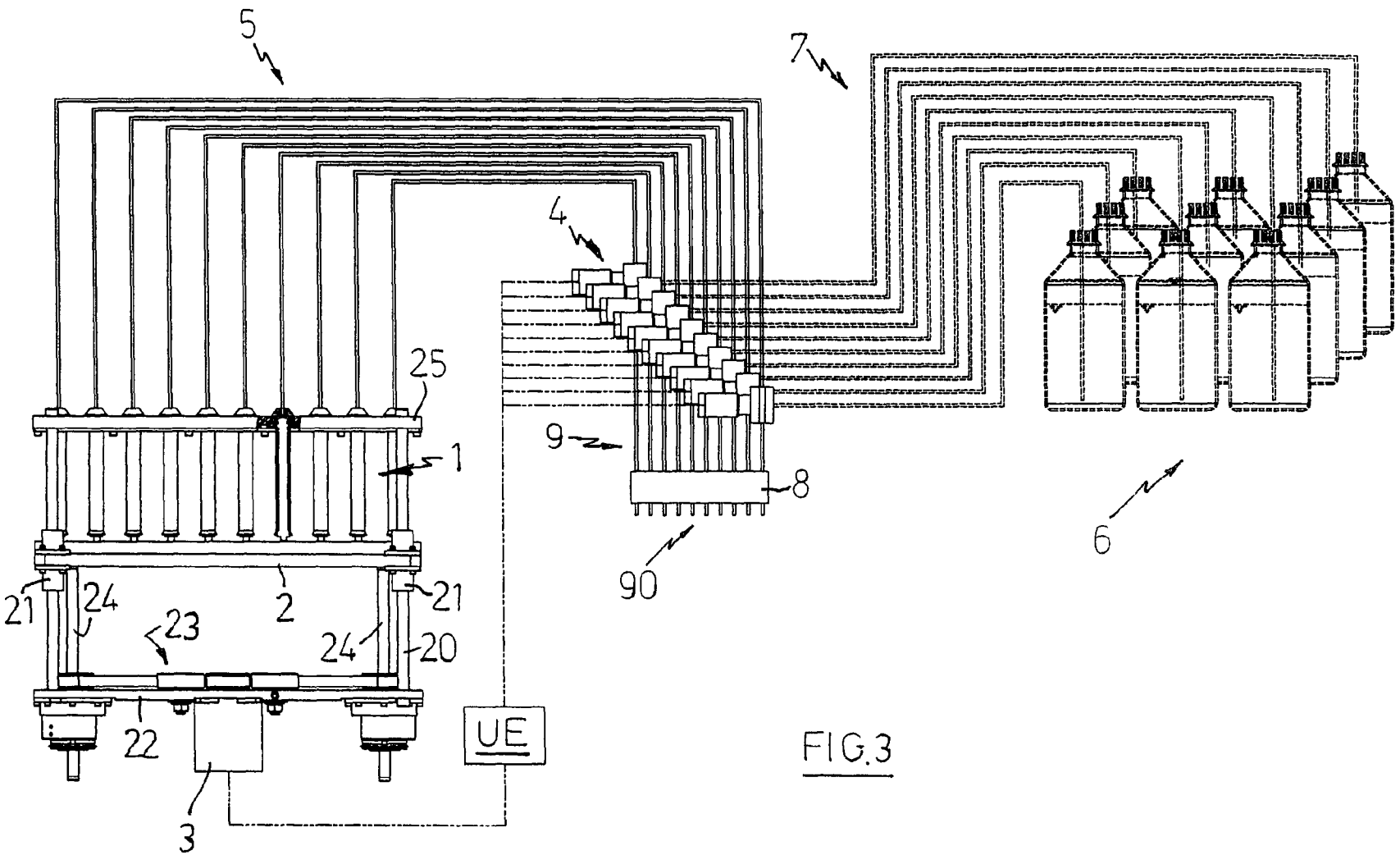
Figure 4:
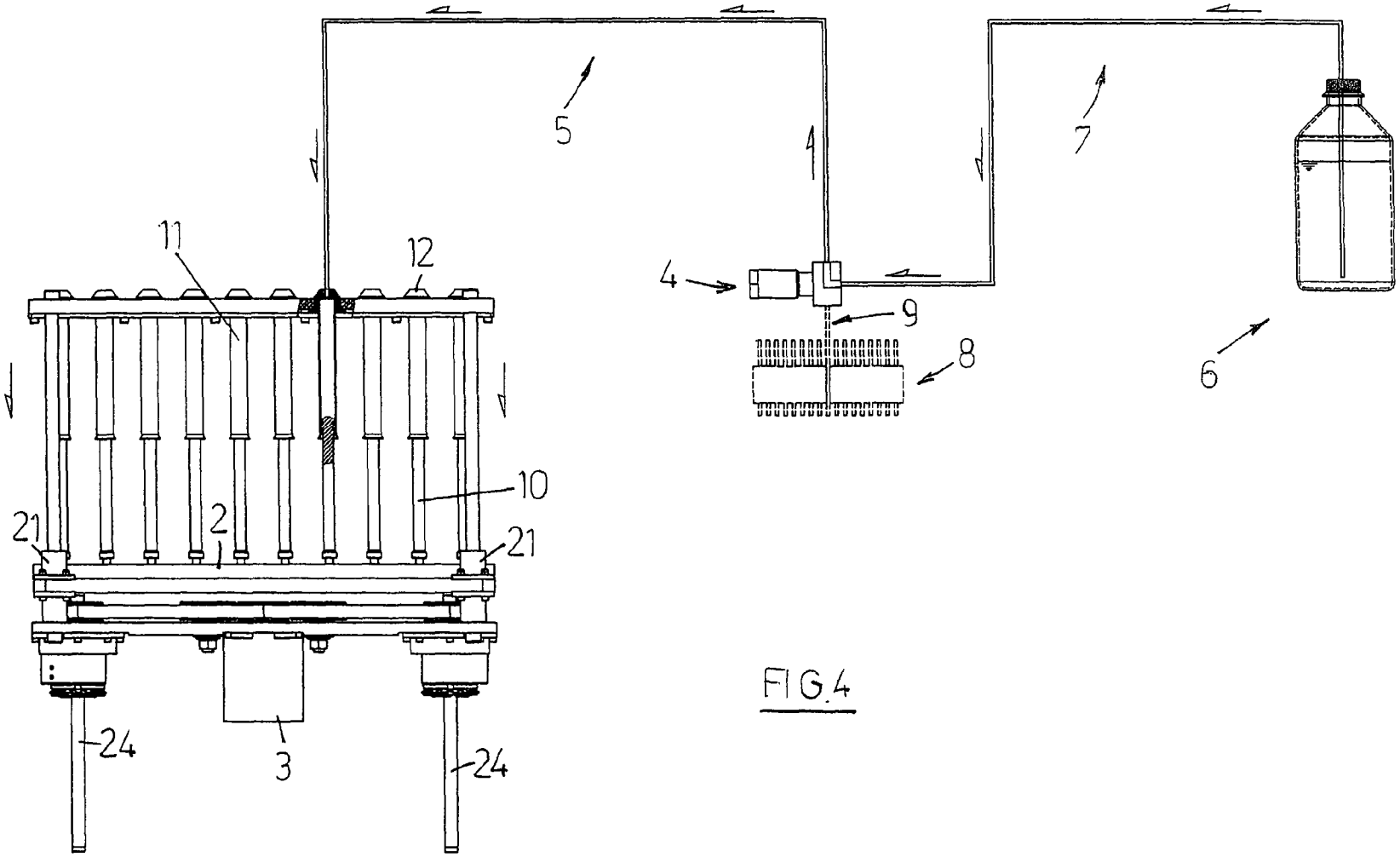
Figure 5:
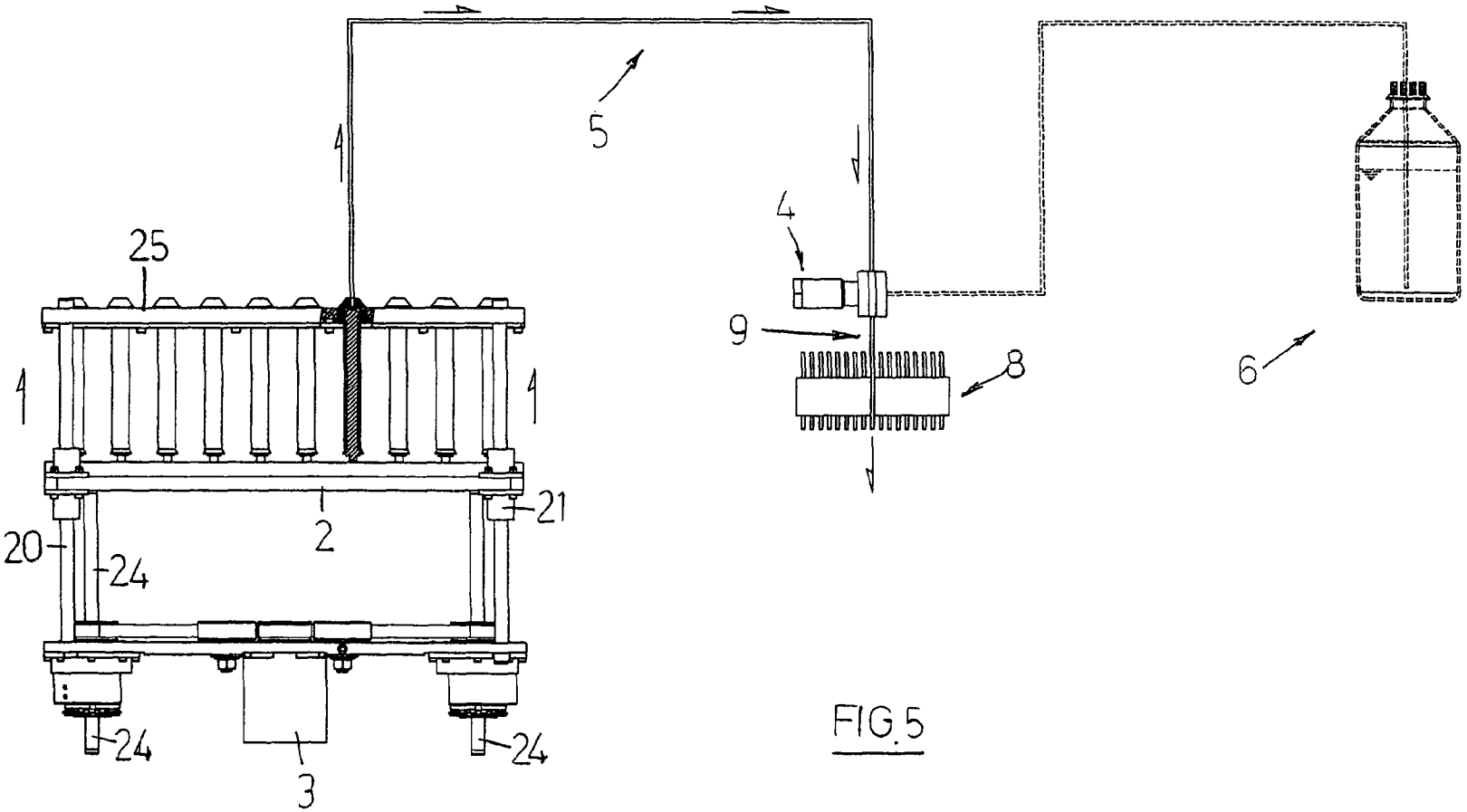
Figure 6:
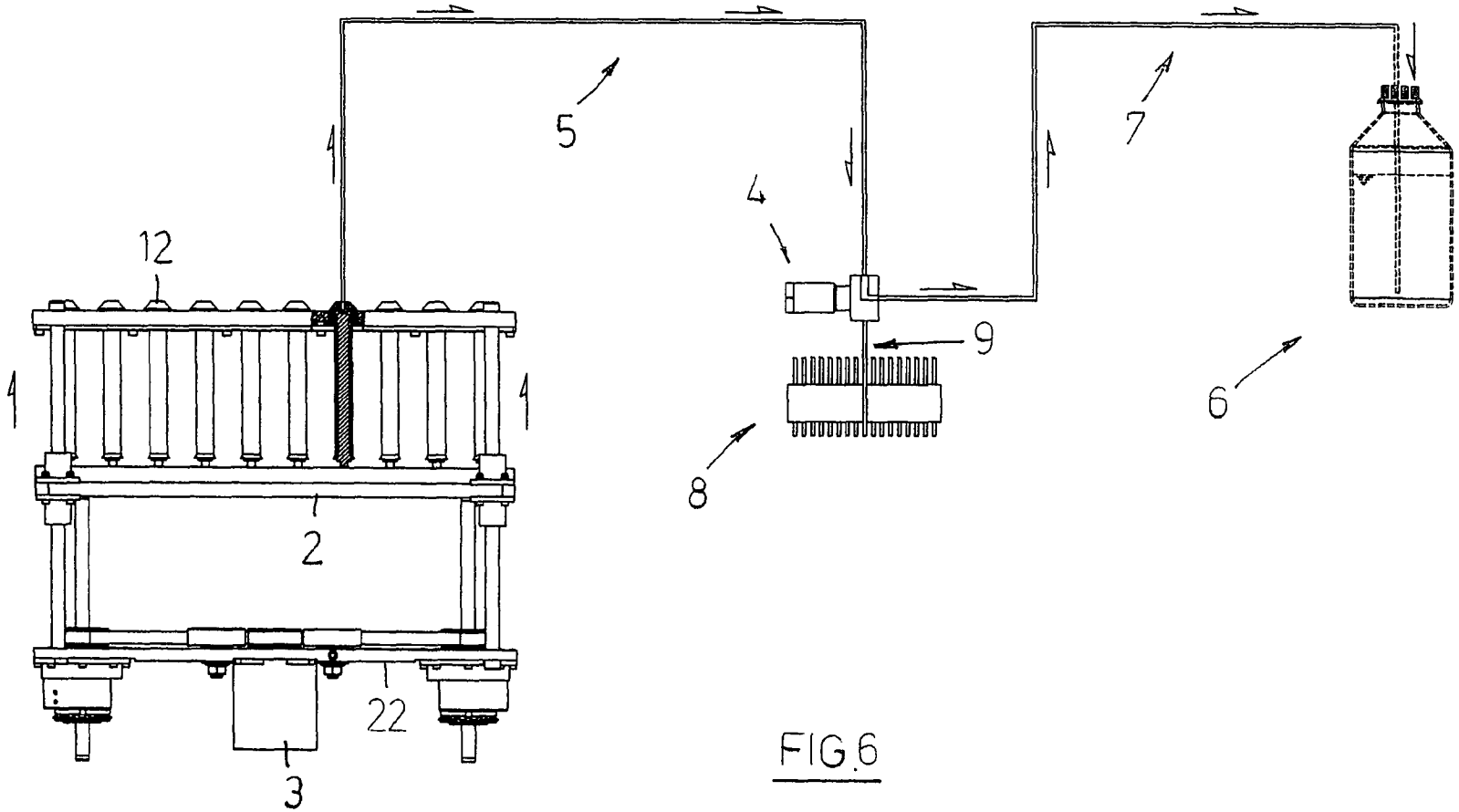
Figure 7:
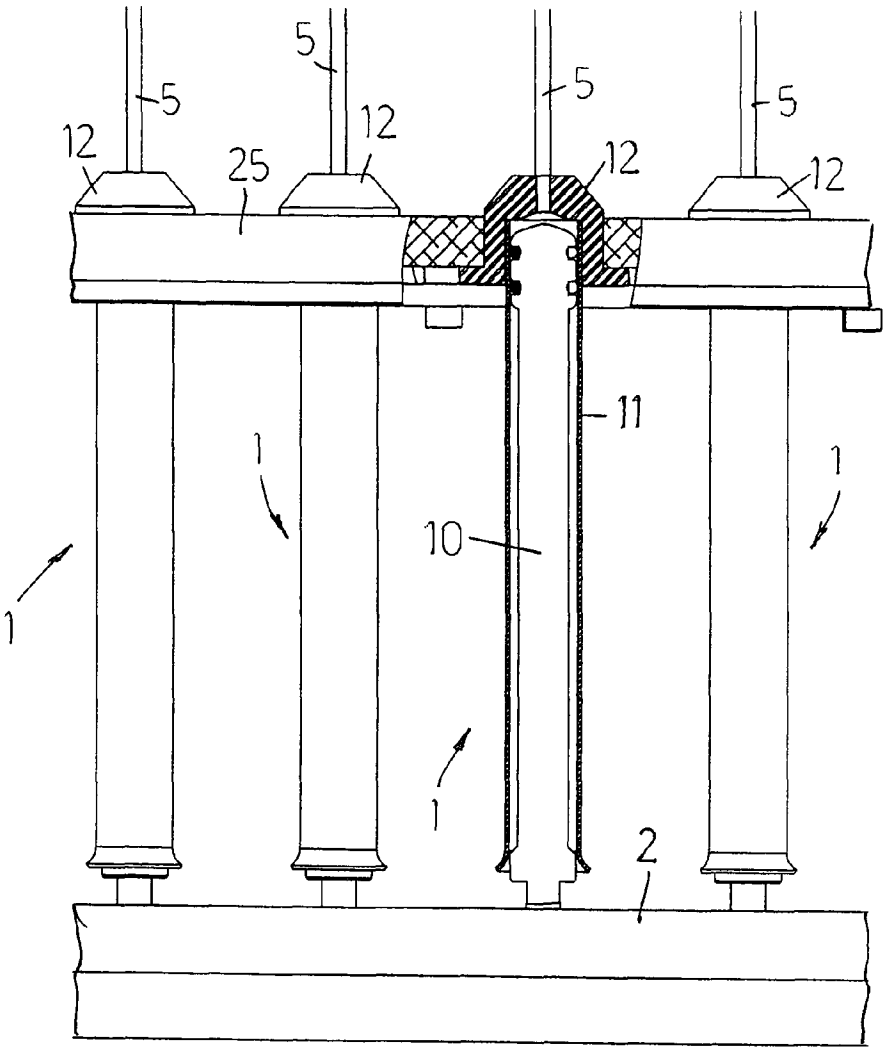

FIG. 3 schematically shows a device according to the present invention;

FIG. 4 shows the device of FIG. 3 during the aspiration of the liquid contained in one of the bottles, in which, for simplification's sake, only part of the device is shown to better illustrate the functioning thereof;

FIG. 5 shows the device of FIG. 3, in the same way as FIG. 4, in a dosing phase;

FIG. 6 shows the device of FIG. 3, in the same way as FIGS. 4 and 5, in a recirculation phase of the liquid;

FIG. 7 shows an enlarged detail of the device shown in FIGS. 3-6.

Reduced to its essential structure and with reference to FIGS. 2-6 of the enclosed drawings, a device according to the present invention comprises:

- a set of pipettes (1) mounted on a horizontal bar (2) vertically moved by an actuator (3), so that the movement of the bar (2) by means of the actuator (3) determines the corresponding lowering or raising of the piston (10) of each pipette (1);
- a plurality of three-path electro-valves (4), each of which is connected
  - (a) to a corresponding pipette (1) by means of a first conduit (5);
  - (b) to a corresponding bottle (6) by means of a second conduit (7), and
  - (c) to a dosing head (8) by means of a third conduit (9).

In practice, the electro-valves (4), the conduits (5), the bottles (6), the conduits (7) and the conduits (9) are in a number which is equal to the number of the pipettes (1).

The bottles (6) contain liquid substances which constitute the components of the formulations or recipes to be prepared as further indicated in the following. In particular, the bottles (6) contain colouring agents in solution or dispersion destined to the preparation of dyeing baths for textile materials.

The end (90) of the conduits (9) which converge into the dosing head (8) exits from the latter and extends underneath it along a portion of length which is not relevant if compared with the length of the conduits (9). In other words, the dosing head (8) exhibits a series of lower nozzles, each or which consists of the end (90) of a corresponding conduit (9).

Said bar (2) is mounted on vertical rods (20) passing through corresponding guiding bushes (21) presented by the same bar (2). The actuator (3) consists of a stepper motor and is attached to the lower base of a fixed frame (22) and, by means of a bilateral belt transmission (23), it drags into rotation two threaded vertical rods (24) passing through corresponding threaded bushes presented by the fixed frame (22). Said bar (2) is fixed on the upper ends of the threaded rods (24). The piston (10) of each pipette (1) is fixed to the mobile bar (2), whereas the shirt (11) of the pipette is attached to a fixed bar (25) in correspondence of the upper part thereof, that is to say to the fixed part of said frame. Therefore, by operating the actuator (3), that is to say by rotating the rods (24) in the clockwise and counter-clockwise direction, it is possible to obtain the lowering and the raising of the pistons (10). As shown in FIG. 7 C, an end cap (12) provided with a central hole, on which one end of a corresponding conduit (5) engages, is fixed on the upper part of the shirt (11) of each pipette (1).

The electro-valves (4), the conduits (5, 7, 9) and the bottles (6) are fixed, that is to say positioned in fixed and predetermined positions. The actuator (3) and the electro-valves (4) are connected to a programmable electronic unit (UE)

- for simplification's sake shown only in FIG. 3 with the corresponding connections indicated with dashed lines—in which it is possible to memorize the quantities of each of the products contained in the bottles (6) to be distributed according to the recipes or formulations to be executed. Said programmable unit (UE) controls the conditions of the actuator (3) and of each of the electrovalves (4). Since the quantity of product distributed by each pipette (1) depends on the run of its corresponding piston (10) and the run depends on the number of steps of the actuator (3) during the raising of the bar (2), the unit (UE) commands the state variation of each electro-valve (4)—as further described in the following—depending on the number of steps of the actuator (3).

It goes without saying that the actuator (3) can be of any other electronically controllable type.

The device described above can be programmed to work as follows.

In a first phase (see. FIG. 4), each of the electro-valves (4) connects the corresponding conduits (5) and (7) to each other, the bar (2) is lowered and, consequently, the pistons (10) of the pipettes (1) are lowered so as to cause the aspiration of liquid from the bottles (6) as indicated by the arrows represented next to the conduits (5) and (7). In this phase, the passage of the liquid takes place through the conduits (5) and (7), whereas the conduits (9) and the dosing head (8) are excluded from said passage In this way, it is possible to obtain the loading of each of the pipettes (1) with the liquid contained in the bottle to which it is connected by means of the corresponding conduits (5) and (7).

In a subsequent phase, depending on the recipe or on the formulation to be executed, a first group of electro-valves (4) connect to each other the conduits (5) and (9) corresponding to the pipettes (1) from which the liquid is to be extracted to execute the recipe, whereas the conditions of a second group, formed by the remaining electro-valves (4), remains unchanged to maintain the connection between the corresponding conduits (5) and (7) thereof. At this point, the bar (2) is raised and, consequently, the pistons (10) of the pipettes (1) are raised and the liquid passes through the conduits (5) and (9) intercepted by the electro-valves (4) of the first group (as schematically represented in FIG. 5) and through the conduits (5) and (7) intercepted by the electro-valves (4) of the second group (as schematically represented in FIG. 6). Therefore, through the dosing head, (8) there is only the passage of the liquid coming from the conduits (5) and (9) which are connected to each other by means of the electro-valves (4) of the first group, whereas the liquid coming from the conduits (5) and (7) connected to each other by the electro-valves (4) of the second group returns to the respective bottles (6). Each of the electro-valves (4) of the first group is then brought back to its initial condition (re-connecting to each other the corresponding conduits 5 and 7) when the quantity of liquid corresponding to the programmed formulation is reached. Said condition is detected by the unit (UE) through the control of the number of steps of the actuator (3). Therefore, the liquid substances return to their corresponding bottles (6), both when their use is not foreseen in a programmed formulation, and at the end of the dosing phase.

According to the present invention, it is therefore possible to obtain, depending on the programmed formulation, (quantity and type of liquid), the automatic subdivision or automatic selection of the electro-valves (4) into two groups, wherein:

a first group of electro-valves (4) which initially connect their corresponding bottles (6) to their corresponding pipettes (1) by means of the conduits (5) and (7), analogously to the electro-valves (4) of the second group, and which, in a subsequent phase, connect their respective pipettes (1) to the dosing head (8) by means of the conduits (5) and (9) and then individually provide the initial connections after the dosing phase has taken place; and the electro-valves (4) of the second group constantly maintain the connection between their respective pipettes (1) and their corresponding bottles (6).

By the word. "group" it is meant a number of electro-valves or even a single unit.

Since the electro-valves (4) are mounted in correspondence of the dosing head (8), the conduits (9) have a reduced length.

Moreover, the liquids which are not involved in the dosage, that is to say those which do not pass through the conduits (9), are always moved (from the bottles 6 to the pipettes 1 or vice-versa).

Therefore, there will not be experienced the problems connected with the sedimentation of liquids in the conduits (5, 7, 9) of the device.

In practice, the construction details may equally vary as regards the single described and illustrated elements, without nevertheless departing from the adopted solution idea and within the limits of the protection granted to the present patent.

The invention claimed is:

1. A device for dosing dyes in solution or dispersion for the preparation of dye baths for textile materials, the device comprising:

a plurality of pipettes individually connected to corresponding bottles or containers containing dyes, said bottles or containers being respectively connected to a dosing head through corresponding third conduits from which the dyes exit;

a plurality of electrovalves, each of said plurality of electrovalves being connected with a corresponding pipette by a first conduit, with a corresponding bottle by a second conduit and with the dosing head through one of said third conduits, in which a dosage involves a delivery of preset quantities of dyes individually through the third conduits connected with the dosing head;

a programmable means for individually controlling said pipettes and said electrovalves and for operating an automatic subdivision or selection of the electrovalves in two groups, wherein, according to a programmed formulation:

a first group of electrovalves initially connect respective bottles with corresponding pipettes through the first conduits and the second conduits, as the electrovalves of a second group, and in a subsequent dosing step connect the respective pipettes with the dosing head through the first conduits and the third conduits and then restore individual links once the dosing is completed; and the electrovalves of the second group constantly maintain a connection between the respective pipettes and the corresponding bottles such that respective not dosed dyes are recirculated to each bottle through the respective first conduits and second conduits.

2. A device according to claim 1, wherein said electrovalves are three-way electrovalves.

3. A device according to claim 1, wherein each of the pipettes comprises a plunger sliding in a tubular jacket, said plungers of the pipettes being solid with a horizontal bar which is moved vertically by an actuator, so that movement of the bar provoked by the actuator determines corresponding lowering or lifting of the piston of each of the pipettes, said actuator being controlled by said programmable means.

4. A device according to claim 1, wherein the programmable unit is programmed so as to perform the following steps:

in a first step, each electro-valve connects corresponding first conduits and second conduits and to each other, allowing aspiration of liquid from the bottles, with a passage of liquid through the first conduits and the second conduits, while the third conduits and the head of dosing are excluded from the passage of liquid to allow loading of each of the pipettes with the liquid contained in the bottle with which the bottle is connected through respective first conduits and second conduits;

in a subsequent step, a first group of electrovalves connect to each other the first conduits and third conduits corresponding to the pipettes from which the liquid is to be taken to execute the recipe, while a status of a second group, comprising remaining electrovalves, remains unchanged so as to keep the connection between respective first conduits and second conduits such that respective not dosed dyes are re-circulated to each bottle through respective first conduits and second conduits, allowing the passage of liquid through the first conduits and third conduits intercepted by the electrovalves of the first group and through the first conduits and second conduits intercepted by the electrovalves of the second group, such that through the dosing head passes only liquids coming from the first conduits and third conduits connected by the electrovalves of the first group while the liquids coming from the first conduits and second conduits connected by the electrovalves of the second group is returned back to respective bottles;

then, each electro-valve of the first group is restored to an initial state, reconnecting with each other the respective first conduits and second conduits when an amount of liquids correspondingly required by the programmed formulation is achieved so that the liquids return back to respective bottles when the liquids are not to be used and at an end of a dosing phase.

5. A device according to claim 3, wherein said mobile bar is mounted on vertical rods passing through corresponding guide bushings provided by the mobile bar, the actuator comprising a stepper motor which is mounted on a lower basis of a fixed frame and, through a bilateral belt transmission, drags in rotation two vertical threaded rods passing through corresponding threaded bushings provided by the fixed frame, said mobile bar being mounted on upper ends of said threaded rods, the plunger of each pipette being fixed to the mobile bar, while the jacket of the pipette is fixed, in correspondence of an upper part thereof, to a fixed part of said frame.

6. A device for dosing dyes in solution or dispersion for the preparation of dye baths for textile materials, the device comprising:

a dosing head;

a plurality of containers, each of said containers comprising a dye;

a plurality of electrovalves;

a plurality of first conduits;

a plurality of second conduits;

a plurality of third conduits;

a plurality of pipettes, each of said pipettes being connected to one of said plurality of electrovalves via one of said first conduits, each of said containers being connected to one of said plurality of electrovalves via one of said second conduits, each of said third conduits being connected to one of said electrovalves;

a programmable means for individually controlling said pipettes and said electrovalves such that at least one of said pipettes is in communication with one of said containers via one of said first conduits, one of said electrovalves and one of said second conduits and at least another one of said pipettes is in communication with said dosing head via another one of said first conduits, another one of said electrovalves and one of said third conduits to deliver a dose of said dye, wherein said dye that is not delivered to said dosing head in said at least one of said pipettes is recirculated to said one of said containers via one of said electrovalves, one of said first conduits and one of said second conduits.

7. A device according to claim 6, further comprising:

an actuator controlled via said programmable means;

a fixed frame, said actuator comprising a bilateral belt transmission and a motor connected to a lower portion of said fixed frame;

a mobile bar mounted on vertical rods, said mobile bar comprising bushings, each of said vertical rods extending through one of said bushings, each of said pipettes comprising a plunger sliding in a tubular jacket, said plungers of the pipettes being integrally connected to said mobile bar, wherein two said vertical threaded rods are rotated via said motor and said bilateral belt transmission, said mobile bar being mounted on upper ends of said threaded rods, said plunger of each of said pipettes being fixed to said mobile bar, said jacket of each of said pipettes being fixed to a fixed part of said frame.

8. A device for dosing dyes in solution or dispersion for the preparation of dye baths for textile materials, the device comprising:

a dosing head;

a plurality of containers, each of said containers comprising a dye;

a plurality of electrovalves, each of said electrovalves being movable between at least a first position and a second position;

a plurality of first conduits;

a plurality of second conduits;

a plurality of third conduits;

a plurality of pipettes, each of said pipettes being connected to one of said plurality of electrovalves via one of said first conduits, each of said containers being connected to one of said plurality of electrovalves via one of said second conduits, each of said third conduits being connected to one of said electrovalves;

a programmable means for individually controlling said pipettes and said electrovalves such that at least one of said first conduits is communication with one of said second conduits with one of said electrovalves in said first position to define a first fluid flow path and said dosing head is in communication with another one of said first conduits and one of said third conduits with another one of said electrovalves in said second position, wherein said dye flows from at least one of said containers to at least one of said pipettes via at least said first fluid flow path and said dye flows from at least another one of said pipettes to said dosing head via said second fluid flow path, wherein said dye in at least one of said pipettes that is not delivered to said dosing head is recirculated to at least one of said containers via said first fluid flow path.

9. A device according to claim 8, wherein said at least one of said pipettes is in communication with one of said containers via said one of said first conduits and said one of said second conduits with said one of said electrovalve in said first position, said another one of said pipettes being in communication with said dosing head via said another one of said first conduits and said one of said third conduits with said another one of said electrovalves in said second position.

10. A device according to claim 8, further comprising:

an actuator controlled via said programmable means;

a fixed frame, said actuator comprising a bilateral belt transmission and a motor connected to a lower portion of said fixed frame;

a mobile bar mounted on vertical rods, said mobile bar comprising bushings, each of said vertical rods extending through one of said bushings, each of said pipettes comprising a plunger sliding in a tubular jacket, said plungers of the pipettes being connected to said mobile bar, wherein two said vertical threaded rods are rotated via said motor and said bilateral belt transmission, said mobile bar being mounted on upper ends of said threaded rods, said plunger of each of said pipettes being fixed to said mobile bar, said jacket of each of said pipettes being fixed to a fixed part of said frame.

* * * * *